US005248443A

United States Patent [19]

Ehrhart et al.

[11] Patent Number: 5,248,443

[45] Date of Patent: * Sep. 28, 1993

[54] SEAM CLEANING COMPOSITION

[75] Inventors: Wendell A. Ehrhart, Red Lion; William T. Sigman, Quarryville; Albert C. Weidman, East Petersburg, all of Pa.

[73] Assignee: Armstrong World Industries, Inc., Lancaster, Pa.

[ * ] Notice: The portion of the term of this patent subsequent to Mar. 30, 2010 has been disclaimed.

[21] Appl. No.: 973,662

[22] Filed: Nov. 9, 1992

Related U.S. Application Data

[63] Continuation of Ser. No. 737,216, Jul. 29, 1991, Pat. No. 5,198,142.

[51] Int. Cl.[5] ..... C11D 7/50

[52] U.S. Cl. ..... 252/163; 106/11; 134/42

[58] Field of Search ..... 252/163; 106/11

[56] References Cited

U.S. PATENT DOCUMENTS

| | | | |
|---|---|---|---|
| 3,071,479 | 1/1963 | Fulenwider | 106/10 |
| 4,370,174 | 1/1983 | Braithwaite | 252/163 X |
| 4,676,920 | 6/1987 | Culshaw | 252/163 |
| 4,693,840 | 9/1987 | Trinh et al. | 106/11 X |
| 4,869,842 | 9/1989 | Denis et al. | 252/163 X |

FOREIGN PATENT DOCUMENTS 2-182778 1/1989 Japan .

*Primary Examiner*—Patrick P. Garvin

[57] ABSTRACT

A seam cleaning paste, cream or liquid is disclosed, which comprises a hydrocarbon solvent and a finely divided inorganic powder. Treatment of the area near the seams of various types of floor coverings, especially highly stain resistant and soil resistant floor coverings, does not significantly change the appearance of the floor nor its resistance to soiling or staining. Yet it results in much improved adhesion of certain seam coaters subsequently applied to bridge the seam and prevent dirt from lodging therein. These creams do not exaggerate bubble formation in subsequently applied seam coaters and in fact, preferred embodiments help prevent such bubbles from forming.

13 Claims, No Drawings

SEAM CLEANING COMPOSITION

CROSS REFERENCE TO RELATED APPLICATION

This is a continuation of application Ser. No. 737,216, filed Jul. 29, 1991, now U.S. Pat. No. 5,198,142.

FIELD OF THE INVENTION

The invention relates to a composition for cleaning the seams, cuts and tears of a flooring structure prior to bonding the floor covering pieces together. More particularly, the invention relates to a composition comprising a hydrocarbon solvent and a finely divided inorganic powder. Preferably, the hydrocarbon is a branched aliphatic and has a boiling point between about 170° C. and about 200° C., and the inorganic powder has a mean particle size of between about 1 micron and about 15 microns and a Moh's hardness of between about 3 and about 7.

BACKGROUND OF THE INVENTION

Recent introduction of "high performance" finishes to residential sheet flooring has compounded the problem of sealing and/or coating the seams to keep unsightly and unremovable dirt from lodging therein. These surfaces were designed to be impervious to diffusion and for easy release of soil. Not surprisingly, it has been exceedingly difficult to find coatings which stick to these surfaces, especially coatings which, upon ambient drying, would have soiling and staining properties similar to the "high performance" surface. Moreover, there has been a proliferation of surface types in the field, including urethane, melamine and thin acrylic wear layers, which make it especially difficult to find a single coating which can be used on all products. (Multiple specific solutions are confusing to floor covering installers.) The present invention embodies a practical approach to rendering many such surfaces more amenable to bonding by various seam coater candidates.

Various methods have been proposed to make high performance surfaces more amenable to adhesion. These have included relatively severe abrasion, corona and electrical discharge treatments, and putting down a rubbery primer. Some rubbery materials adhere to the high performance wear layers, but soil and stain badly. Although these treatments were more or less successful in terms of improving adhesion, they are generally too cumbersome, too dangerous, or otherwise impractical. Grossly abraded or primed areas must be covered exactly with the seam coater as any uncovered areas will have reduced gloss and/or will, soil and stain excessively, and if the coater is applied wider than the treated area, it will come loose around the edges allowing dirt to be trapped underneath. Either of these situations contribute further to the adverse aesthetics of the seam.

SUMMARY OF THE INVENTION

In accordance with the present invention, a seam cleaning composition comprises a hydrocarbon solvent and a finely divided inorganic powder, the hydrocarbon solvent being predominately a branched aliphatic and having a boiling point between about 90° C. and about 260° C., the inorganic powder having a mean particle size of less than about 100 microns and a Moh's hardness of about 1 to about 8. Although lower and higher boiling point solvents may be used, lower boiling point solvents evaporate too quickly and are more flammable, and higher boiling point solvents evaporate too slowly. These conditions make application and removal of the cleaning composition more difficult. The preferred boiling point of the hydrocarbon solvent is between about 170° C. and about 200° C. Preferably the composition is substantially free of water The preferred mean particle size of the inorganic powder is about 1 micron to about 15 microns. Smaller particles may be less efficient at scouring the surface. Particles with a mean particle size greater than about 100 microns can visibly scratch and dull the high performance surface.

The preferred Moh's hardness of the inorganic powder is about 3 to about 7. Powder having a Moh's hardness of greater than 8 may tend to excessively dull or shine the wear layer depending on particle size. Powder having a Moh's hardness of less than 1 may be less effective at promoting adhesion.

Preferably the inorganic powder is limestone. However, the inorganic powder may be a silicate, preferably an anhydrous sodium potassium aluminum silicate. A preferred embodiment includes a combination of limestone and anhydrous sodium potassium aluminum silicate.

In another embodiment, the seam cleaning composition consists essentially of about 15 to about 80, preferably about 25 to about 45, Weight percent based on the total composition of hydrocarbon solvent, and about 20 to about 85, preferably about 55 to about 75, weight percent based on the total composition of finely divided inorganic powder having a mean particle size of less than about 100 microns, preferably about 0.5 micron to about 20 microns, and a Moh's hardness of about 1 to about 8, preferably about 2 to about In yet another embodiment, the invention is a flooring system comprising (a) two floor coverings each having an exposed surface, the floor coverings having abutting edges forming a seam, and (b) a seam cleaning composition comprising a hydrocarbon solvent and a finely divided inorganic powder, the hydrocarbon solvent having a boiling point between about 90° C. and about 260° C., the inorganic powder having a mean particle size of less than about 100 microns and a Moh's hardness of about 1 to about 8 applied to the exposed surface of the floor coverings adjacent the seam. A further embodiment of the invention is a method of cleaning the seam, cut or tear of a flooring system. A seam is formed when two floor coverings each having an exposed surface, are abutted The method comprises the steps of (1) applying the seam cleaning composition to the exposed surface of the floor covering adjacent the seam, cut or tear, (2) rubbing the seam cleaning composition adjacent the seam, cut or tear with hand pressure, and (3) removing substantially all of the seam cleaning composition. Preferably after the seam cleaning composition is applied and rubbed, a majority of composition is removed, the residue is allowed to dry to a white powder, and the dried powder is wiped off.

DETAILED DESCRIPTION OF THE INVENTION

Seam cleaning pastes, creams and liquids of the present invention are obtained by blending together a hydrocarbon solvent and a finely divided inorganic powder. The inorganic powders are often referred to as fillers and/or pigments. Mean particle sizes in the less than 100 micron range and Moh's hardness of 3 to 7 have been shown to work. It is believed that any particle size small enough to form a reasonably stable paste will work.

Treating (rubbing with the cream) the area near the seams of various types of high gloss flooring surfaces, including certain "high performance" surfaces, does not change the appearance of the floor nor its resistance to soiling or staining, yet it results in much, improved adhesion of certain seam coaters subsequently applied to bridge the seam and prevents dirt from lodging therein. The creams of the present invention do not enhance bubble formation, as some tested compositions which do create additional problems by increasing the bubble formation in the subsequently applied seam coater.

In fact, preferred embodiments of the present invention contain highly branched aliphatic hydrocarbons which surprisingly help prevent bubbles from forming in subsequently applied seam coaters. Especially preferred are solvents having a boiling point between 170° C. and 200° C., e.g., EXXON Corp.'s Isopar H, and Isopar K. The higher boiling ranges are especially advantageous in deterring bubble formation and are nearly odorless. However, those that boil above about 200° C dry so slowly as to make complete removal of the composition more difficult or inordinately time consuming.

It is believed that stronger solvents would have detrimental effects such as swelling or dissolving the substrate and causing bubbles to form in the subsequent coater. While improving adhesion, a paste made from the partially aromatic, very high boiling, dodecylbenzene greatly exaggerated the formation of bubbles (many more than with no seam treatment). The formation of bubbles is, of course, dependent on other factors as well (e.g., thickness of coating deposited and ambient relative humidity) so small differences in numbers of bubbles in a given experiment are not necessarily significant.

The mechanism of action of these creams is not definitely known, either in terms of adhesion enhancement or bubble suppression, however, it is suspected that adhesion enhancement occurs primarily as a result of removal of unwanted surface contaminates such as release agents and that the bubble suppression may result from the filling of tiny air holding imperfections in the substrate by the low surface tension, poorly solvating branched hydrocarbons.

Installers seem to like to use the creams partly because they are quite useful for cleaning up bits of the full spread flooring adhesive which inevitably end up on the flooring surface near the seam during installation. The creams are also useful for cleaning up dirty seams (never sealed or coated) on old floors prior to coating the seam to keep the problem from recurring. The creams contain no invisible non-volatile components such as surfactants which could easily be left behind inadvertently and perhaps interfere with the adhesion of the seam coater.

The preferred Isopar solvents and mineral spirits have Aniline points, as measured by the method of ASTM D 611, of between 76° C. and 88° C. The straight chain alkane and aromatic solvents have Aniline points of between 8° C. and 62° C. Therefore solvents having Anilines points of at least 75° C. appear to avoid an increase in bubble formation.

In like manner, the preferred Isopar solvents and mineral spirits have Kauri-Butanol numbers between 27 and 29, as measured by the method of ASTM D 1133. The straight chain alkane and aromatic solvents have Kauri-Butanol numbers between 31 and 105. Therefore, solvents having a Kauri-Butanol number of no greater than 30 appear to avoid an increase in bubble formation.

EXAMPLE 1

Forty-four grams of Isopar H (a nearly odorless, highly branched aliphatic hydrocarbon fraction, boiling range 176°–188° C., sold by EXXON Corp.) and 56 G of Gamaco (a dry ground limestone, mean particle size 3.8 microns, Moh's hardness of 3, sold by Georgia Marble Co.) were stirred together to form a soft cream or paste. This was used to treat the surface of a seam in Armstrong's Designer Solarian sheet flooring (Clean Sweep surface). A piece of cloth was placed over the index finger, and dipped into the cream. A section of the seam (about ½ inch on either side of the seam) was rubbed several times with this cream using modest pressure. The smeared cream on treated sections of the seam showed exactly which areas were already treated and which still needed to be worked on. When the entire seam had been treated, a cloth was used to remove the bulk of the cream, leaving a thin film of cream still on the floor. After waiting five minutes, most solvent had evaporated from the remaining film, leaving an approximately 1" wide, whitened swathe of limestone. This was then easily removed with a clean, dry cloth. An eye dropper was used to treat the seam with a 39% solids, polyester based, moisture curable polyurethane seam coater (disclosed in pending U.S. patent application Ser. No. 643,214). The seam coater was allowed to cure and dry overnight. This resulted in a ⅛ to ¼ inch wide bubble-free coating bridging the seam. This coating had excellent adhesion to the flooring substrate as the bead could not be removed with the aid of a pointed knife. The same coating generally has a few bubbles and is quite easily removed from an untreated Designer Solarian surface. The uncovered portion of the treated area was not visibly different from untreated flooring, nor did it show enhanced soiling or household staining (i.e., iodine, hair dye, shoe polish, etc.).

EXAMPLE 2-5

Table 1 below lists cream formulations prepared and used to treat Designer Solarian seams in the same manner as that in Example 1, however, the film of cream left after initial removal had not dried after five minutes in the case of Example 5, so it was removed by hard wiping several times with dry cloths. Also, the subsequently applied coater was a polyether based moisture curable polyurethane. Results obtained on applying the seam coater are given in the table also.

TABLE 1

| | Example 2 | Example 3 | Example 4 | Example 5 |
|---|---|---|---|---|
| Isopar C (BR HC, boils 97–107° C.) | 44 G | — | — | — |
| Isopar G (BR HC, boils 156–176° C.) | — | 44 G | — | — |
| Low Odor Min Spirits (Boils 161–189° C.) | — | — | 44 G | — |
| Isopar M (BR HC, boils 207–254° C.) | — | — | — | 44 G |
| Gamaco Limestone | 56 G | 56 G | 56 G | 56 G |
| Bubbles in Coater | Very Few | Very Few | A Few | None |
| Adhesion of Coater | Excellent | Excellent | Excellent | Excellent |

TABLE 1-continued

| | Example 2 | Example 3 | Example 4 | Example 5 |
|---|---|---|---|---|
| @ 24+ hrs. | | | | |

Application of this same seam coater to untreated Designer Solarian seams resulted in a few bubbles (approximately the same as Example 4) and very poor adhesion.

EXAMPLE 6–9

Table 2 below lists cream formulations prepared and used to treat Designer Solarian seams in the same manner as that in Example 1, however, the film of cream left after initial removal had not completely dried after five minutes in the case of Examples 8 and 9, so its removal was more difficult. Results obtained on applying the seam coater of Example 1 are also given.

TABLE 2

| | Example 6 | Example 7 | Example 8 | Example 9 |
|---|---|---|---|---|
| Low Odor Mineral Spirits | 44 G | — | — | 27 G |
| Isopar G | — | 44 G | — | — |
| Isopar M | — | — | 44 G | 17 G |
| Gamaco Limestone | 56 G | 56 G | 56 G | 56 G |
| Bubbles in Coater | Very Few | Very Few | Very Few | Very Few |
| Adhesion of Coater @ 24+ hrs. | Excellent | Excellent | Excellent | Excellent |

The same coater applied to a similar seam given no treatment, developed significantly more bubbles than the above and had quite poor adhesion. Applied to a seam cleaned with Soft Scrub (a commercial, aqueous scouring paste), then wiped clean, the same coater had excellent adhesion but developed many more bubbles.

EXAMPLE 10

A most preferred cream contained 40 G of Isopar H, 45 G of Gamaco, and 15 G of Minex 10. It was odorless, had a nice consistency, and was shown to be effective at improving adhesion of several seam coaters on several flooring substrates with minimization of bubbles. Minex 10 is a dry ground anhydrous sodium potassium aluminum silicate with a mean particle size of 2.3 microns (top particle size =10 microns). It has an Moh's hardness value of 5.5 to 6.0 vs. about 3 for the Gamaco.

EXAMPLE 11

A cream made from 33 G of Isopar H and 67 G of Gamaco was usable, but was more viscous than would be desired for easy handling. It did not stick to the cloth wheel.

EXAMPLE S 12 to 22

Table 3 below lists additional cream formulations prepared and used to treat Designer Solarian seams in the same manner as that in Example 1. In each case the adhesion of the seam coater of Example 1 was excellent while adhesion of the seam coater on the untreated Designer Solarian seams was poor. Except for Example 22, the cream formulations did not cause any noticeable effect on floss or soil release.

TABLE 3

| | Example 12 | Example 13 | Example 14 | Example 15 |
|---|---|---|---|---|
| Isopar H | 32.5 | 32.5 | 32.5 | 27.0 |
| Gamaco | 50.6 | 67.5 | — | 73.0 |
| Minex 10 | 16.9 | — | 67.5 | — |

| | Example 16 | Example 17 | Example 18 | Example 19 |
|---|---|---|---|---|
| Isopar H | 36.0 | 28.0 | 32.0 | 44.0 |
| Gamaco | — | 36.0 | 34.0 | — |
| Minex 10 | 64.0 | — | — | — |
| Minex 2[a] | — | 36.0 | — | — |
| Minex 4[b] | — | — | 34.0 | — |
| Imsil A-15[c] | — | — | — | 56.0 |

| | Example 20 | Example 21 | Example 22 |
|---|---|---|---|
| Isopar H | 22.0 | 25.0 | 21.0 |
| Gamaco | — | 75.0 | — |
| 325 Mesh Limestone[d] | 78.0 | — | — |
| 50 Mesh Limestone[e] | — | — | 79.0 |

[a]Dry ground Nepheline Syenite, mean particle size 16μ, largest size 105μ
[b]Dry ground Nepheline Syenite, mean particle size 7.5μ, largest size 44μ
[c]Microcrystalline silica, mean particle size 2.5μ, largest size about 40μ, Moh's hardness 7
[d]Mean particle size 12μ, largest size about 44μ
[e]Mean particle size 90μ, largest size about 300μ

What is claimed is:

1. A seam cleansing composition comprising a hydrocarbon solvent and a finely divided inorganic powder, the hydrocarbon solvent in predominately a branched aliphatic having a boiling point between about 90° C. and about 260° C., the inorganic powder having a means particle size of less than about 100 microns and a Moh's hardness of about 1 to about 8, the seam cleansing composition being substantially free of long-chain fatty alcohol and water.

2. The composition of claim 1 wherein the hydrocarbon solvent has an aniline point of at least 75° C.

3. The composition of claim 1 wherein the hydrocarbon solvent has a Kauri-Butanol number of no greater than 30.

4. The composition of claim 1 wherein the inorganic powder has a Moh's hardness of about 3 to about 7.

5. The composition of claim 1 wherein the inorganic powder is limestone.

6. The composition of claim 5 further comprising a silicate.

7. The composition of claim 1 wherein the inorganic powder is an anhydrous sodium potassium aluminum silicate.

8. The composition of claim 1 wherein the inorganic hydrocarbon solvent and a finely divided inorganic powder, the hydrocarbon solvent being predominately a branched aliphatic having a boiling point between about 90° C. and about 260° C., the inorganic powder having a means particle size of less than 10 microns and a Moh's hardness of about 1 to about 8.

9. A seam cleaning composition comprising 15 to 80 weight percent based on the total composition of a branched aliphatic hydrocarbon solvent, and 20 to 85 weight percent based on the total composition of finely divided inorganic powder having a mean particle size of less than about 100 microns and a Moh's hardness of about 1 to about 8.

10. The composition of claim 9 wherein the hydrocarbon solvent has a boiling point between about 90° C. and about 260° C.

11. The composition of claim 9 wherein the inorganic powder is limestone.

12. The composition of claim 9 wherein the inorganic powder is a combination of limestone and silicate.

13. The composition of claim 9 wherein the inorganic powder is an anhydrous sodium potassium aluminum silicate.

* * * * *

UNITED STATES PATENT AND TRADEMARK OFFICE

CERTIFICATE OF CORRECTION

PATENT NO. : 5,248,443

DATED : September 28, 1993

INVENTOR(S) : Wendell A. Ehrhart et al.

It is certified that error appears in the above-identified patent and that said Letters Patent are hereby corrected as shown below:

Column 2, line 35, "2 to about In yet another" should read --2 to about 7. In yet another--.

Column 5, line 54, "wheel" should read --well--.

Column 5, line 64, "floss" should read --gloss--.

Claim 1, column 6, line 23, "cleansing" should read --cleaning--.

Claim 1, column 6, line 25, "in" should read --being--.

Claim 1, column 6, lines 29 and 30, "cleansing" should read --cleaning--.

Claim 8, column 6, line 45, "The composition of claim 1 wherein the inorganic" should read --A seam cleaning composition comprising a--.

Claim 8, column 6, line 50, "means" should read --mean--.

Signed and Sealed this

Fifth Day of April, 1994

Bruce Lehman

*Attest:*

BRUCE LEHMAN

*Attesting Officer*

*Commissioner of Patents and Trademarks*